US006979072B2

(12) United States Patent
Lin

(10) Patent No.: US 6,979,072 B2
(45) **Date of Patent: *Dec. 27, 2005**

(54) INK-JET PRINTING MODULE HAVING A CLEANING DEVICE AND A COVERING DEVICE AT TWO SIDES OF THE PRINTING PLATFORM

(75) Inventor: Tsung-Te Lin, Sanchung (TW)

(73) Assignee: BENQ Corporation, (TW)

( * ) Notice: Subject to any disclaimer, the term of this patent is extended or adjusted under 35 U.S.C. 154(b) by 0 days.

This patent is subject to a terminal disclaimer.

(21) Appl. No.: 10/782,846

(22) Filed: Feb. 23, 2004

(65) Prior Publication Data

US 2004/0160473 A1 Aug. 19, 2004

Related U.S. Application Data

(63) Continuation of application No. 10/200,945, filed on Jul. 24, 2002, now Pat. No. 6,733,107.

(30) Foreign Application Priority Data

Jul. 25, 2001 (TW) ..... 90212649 U

(51) Int. Cl.[7] ..... B41J 2/165
(52) U.S. Cl. ..... 347/32; 347/29; 347/30; 347/33
(58) Field of Search ..... 347/22–24, 29, 347/30, 32, 33, 35

(56) References Cited

U.S. PATENT DOCUMENTS

| | | | | |
|---|---|---|---|---|
| 4,144,537 | A | 3/1979 | Kimura et al. | |
| 5,504,508 | A * | 4/1996 | Hashimoto | 347/24 |
| 5,835,109 | A * | 11/1998 | Uchida | 347/24 |
| 6,036,299 | A * | 3/2000 | Kobayashi et al. | 347/30 |
| 6,139,128 | A * | 10/2000 | Magirl et al. | 347/22 |
| 6,733,107 | B2 * | 5/2004 | Lin | 347/33 |

FOREIGN PATENT DOCUMENTS

DE 272 5727 12/1977

* cited by examiner

*Primary Examiner*—Shih-Wen Hsieh
(74) *Attorney, Agent, or Firm*—Rabin & Berdo, PC

(57) ABSTRACT

An ink-jet printing module, positioned in an ink-jet printing mechanism, includes a first side, a second side opposite to the first side, and a guiding bar between the first side and the second side, a print head movable along the guiding bar, a cleaning device, a covering device, and a printing platform. The cleaning device for cleaning the print head is adjacent to an interior of the first side. The covering device for covering the print head is adjacent to an interior of the second side. The printing platform is located at the bottom of the ink-jet printing module and between the cleaning device and the covering device.

21 Claims, 2 Drawing Sheets

INK-JET PRINTING MODULE HAVING A CLEANING DEVICE AND A COVERING DEVICE AT TWO SIDES OF THE PRINTING PLATFORM

This application is a continuation application of U.S. application Ser. No. 10/200,945, filed Jul. 24, 2002 now U.S. Pat. No. 6,733,107.

BACKGROUND OF THE INVENTION

1. Field of the Invention

The invention relates in general to an ink-jet printing module, and more particularly to an ink-jet printing module having a cleaning device and a covering device at two sides of the printing platform.

2. Description of the Related Art

The art of ink-jet technology is relatively well developed. Commercial products such as computer printers, graphics plotters, copiers, and facsimile machines employ ink-jet technology for producing hard copy. The basics of this technology are disclosed, for example, in various articles and patents. One of the main components of the printing machine is a printing module. A conventional printing module is illustrated in FIG. 1A and FIG. 1B.

Referring to FIG. 1A and FIG. 1B, the top view and the side view of the conventional ink-jet printing module are shown, respectively. The ink-jet printing module 100 includes a print-head 102, a guiding bar 104, a printing platform 106, two sides 112*a* and 112*b*, a cleaning device 108 and a covering device 110. The side 112*a* and the side 112*b* are opposite to each other. The guiding bar 104 is located between the side 112*a* and the side 112*b*. One end of the guiding bar 104 is coupled to the side 11 2*a* and the other end of the guiding bar 104 is coupled to the side 112*b*. The print head 102 is movable along at the guiding bar 104 so that the print head 102 is able to move backwards and forwards in the direction indicated by the arrow 150. The bottom surface of the print head 102 is a nozzle surface 102*a* for ink jetting. The printing platform 106 is disposed approximately at the bottom center of the printing module 200.

During or after each printing, ink residue may remain at the nozzle surface 102*a*. When the ink residue accumulates to a certain amount, it may drop onto the printed document and cause contamination. If the ink residue gets dry on the nozzle surface 102*a*, nozzle clogging may occur. Therefore, a cleaning device 108 and a covering device 110 are necessary. The cleaning device 108 is typically a wiper to wipe away the ink residue on the nozzle surface 102*a*. The covering device 110 is typically a cap. The cap 110 is used for providing print head protection and preventing the nozzle from clogging by capping during non-use.

The conventional cleaning device and covering device are formed in a unitary unit, that is, a two-in-one device. The unitary cleaning and covering device is positioned adjacent to one of the two sides of the printing module 100. As a result, the space 160 between the other side 112*a* and printing platform 106 is left empty. Consequently, the printing module 100 as a whole is unbalanced and its sized is hard to reduce. Furthermore, even only one of the wiper and cap wears out, the whole two-in-one device needs to be replaced.

SUMMARY OF THE INVENTION

It is therefore an object of the invention to provide an ink-jet printing module having a cleaning device and a covering device respectively at two sides of the printing platform. In this invention, the space at the both sides of the printing platform can be effectively used. Consequently, the whole size of the printing mechanism can be reduced.

It is another object of the invention to provide an ink-jet printing module, positioned in an ink-jet printing mechanism, wherein the ink-jet printing module has a first side, a second side opposite to the first side, and a guiding bar between the first side and the second side, a print-head, a cleaning device, a covering device, and a printing platform. The print-head is movable along the guiding bar. The cleaning device for cleaning the print head is located at a bottom of the ink-jet printing module and adjacent to an interior of the first side. The covering device for covering the print head is located at the bottom of the ink-jet printing module and adjacent to an interior of the second side. The printing platform is located at the bottom of the ink-jet printing module and between the cleaning device and the covering device. The cleaning device cleans the print-head while the print-head moves to the first side, and the covering device covers the print-head while the print-head moves to the second side.

The printing mechanism can be used in an ink-jet printer, an ink-jet photocopier, and an ink-jet facsimile machine.

Other objects, features, and advantages of the invention will become apparent from the following detailed description of the preferred but non-limiting embodiments. The following description is made with reference to the accompanying drawings.

DETAILED DESCRIPTION OF THE INVENTION

According to the spirit of the invention, an ink-jet printing module having a cleaning device and a covering device respectively at two sides of the printing platform is disclosed. In this invention, the space at the both sides of the printing platform can be effectively used. Consequently, the whole size of the printing mechanism can be reduced. The printing mechanism can be used in an ink-jet printer, an ink-jet photocopier, and an ink-jet facsimile machine. Other objects, features, and advantages of the invention will become apparent from the following detailed description of the preferred but non-limiting embodiment.

Figure 1A:
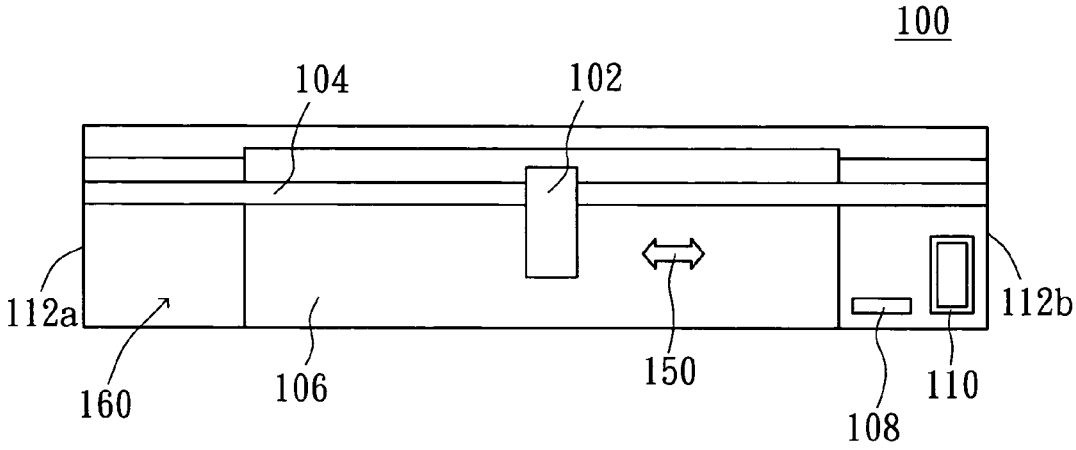
FIG. 1A (PRIOR ART)
FIG. 1A and FIG. 1B (Prior Art) are the top view and the side view of the conventional ink-jet printing module, respectively.
Figure 1B:
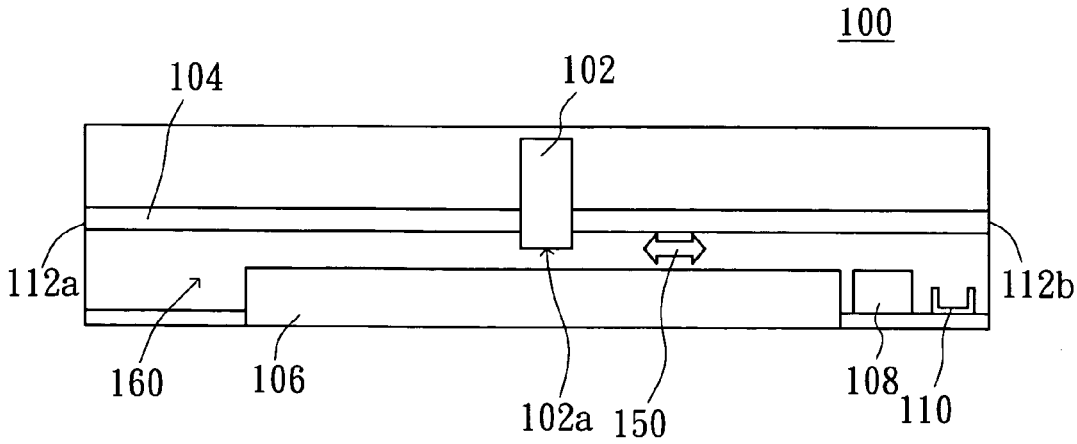
FIG. 1B (PRIOR ART)
Figure 2A:
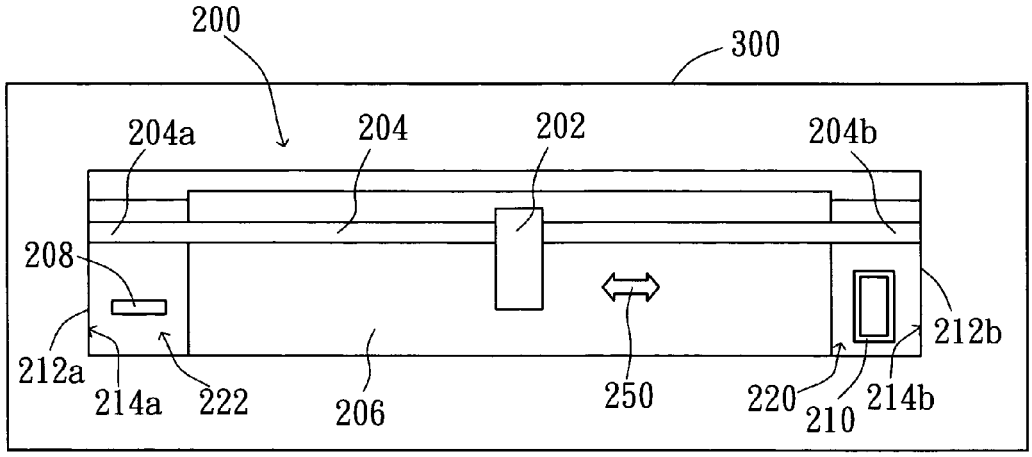
FIG. 2A and FIG. 2B are respectively the top view and the side view of the ink-jet printing module according to a preferred embodiment of the invention.
Figure 2B:
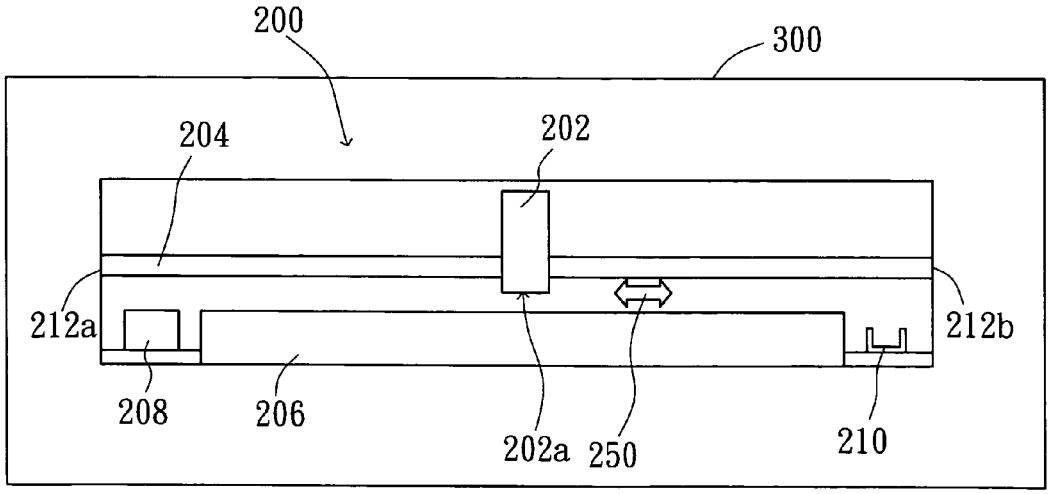

Referring to FIG. 2A and FIG. 2B, the top view and the side view of the ink-jet printing module of the invention are shown, respectively. The ink-jet printing module 200 includes a print-head 202, a guiding bar 204, a printing platform 206, two sides 212*a* and 212*b*, a cleaning device and a covering device. The side 212*a* is opposite to the side 212*b*. The guiding bar 204 is disposed between the two sides 212*a* and 212*b*, with one end 204*a* coupled to the interior 214*a* of the side 212*a* and the other end 204*b* coupled to the interior 214*b* of the side 212*b*. The print-head 202 is movable along the guiding bar 204 so that the print-head 202 is able to move backwards and forwards in the direction indicated by the arrow 250. The bottom surface of the print head 202 is a nozzle surface 202*a* for ink jetting.

The cleaning device of the invention comprises a wiper 208. The wiper 208 is disposed at the bottom of the ink-jet printing module 200 and is adjacent to the interior 214*a* of the side 212*a*. The wiper 208 is used for wiping away the ink residue at the print head 202 after printing. Furthermore, the cleaning device comprises an ink-absorbing device, such as a sponge.

The covering device can be a cap 210. The cap 210 is disposed at the bottom of the ink-jet printing module 200 and is adjacent to the interior 214*b* of the side 212*b*. The cap 210 is used for providing print-head protection by capping and preventing the nozzle form clogging during non-use.

The printing platform 206 is disposed approximately at the bottom center of the printing module 200 and between the wiper 208 and the cap 210.

The movement of the print head 202 is briefly described as follows. Before each printing operation, the print head 202 rests at the capping region 220 and capped by the cap 210. When receiving a printing signal, the print head 202 moves to the wiping region 222. Then, the wiper 208 starts to wipe the print head 202. After that, the print head 202 is ready for printing. During the printing operation, the print head 202 moves backwards and forwards above the printing platform 206. After printing service, the print head 202 moves back to the wiping region 222 and gets cleaned by the wiper 208. Then, the print head 202 returns to the capping region 220 and is capped by the cap 210 until next printing operation.

The ink-jet printing module 200 of the invention can be installed in any ink-jet image forming machine 300, such as an ink-jet printer, an ink-jet photo-copier, an ink-jet facsimile machine and the like.

According to the ink-jet printing module of the invention, the space at the both sides of the printing platform can be effectively used. Consequently, the whole size of the printing mechanism can be reduced and the printing mechanism as a whole is more balanced. Another advantage of the invention is that when either one of the wiper and cap wears out, only the single worn-out device needs to be replaced. As to the conventional two-in-one device, even only one device, for example, the wiper, fatigues, the whole two-in-one device needs to be replaced.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An ink-jet printing module disposed in an ink-jet printing apparatus, comprising:

a guiding device extending from a first end to a second end thereof for supporting a print-head for moving therealong;

a first servicing device of a first kind adjacent to the first end for servicing the print-head; and a second servicing device of a second kind different from the first kind, adjacent to the second end for servicing the print-head;

wherein the first servicing device services the print-head when the print-head moves to the first end, and the second servicing device services the print-head when the print-head moves to the second end.

2. The ink-jet printing module according to claim 1, wherein the guiding device is a guiding bar.

3. The ink-jet printing module according to claim 1, wherein the first servicing device is a cleaning device for cleaning the print-head.

4. The ink-jet printing module according to claim 3, wherein the cleaning device comprises a wiper.

5. The ink-jet printing module according to claim 3, wherein the cleaning device comprises an ink-absorbing device.

6. The ink-jet printing module according to claim 1, wherein the second servicing device is a covering device for covering the print-head.

7. The ink-jet printing module according to claim 6, wherein the covering device comprises a cap.

8. The ink-jet printing module according to claim 1, further comprising a printing platform between the first servicing device and the second servicing device.

9. The ink-jet printing module according to claim 1, wherein the first servicing device is disposed at a bottom of the ink-jet printing module.

10. The ink-jet printing module according to claim 1, wherein the second servicing device is disposed at a bottom of the ink-jet printing module.

11. A method for servicing a print-head of an ink-jet printing module, wherein the ink-jet printing module has a guiding device extending from a first end to a second end thereof for supporting the print-head, the method comprising steps of:

servicing the print-head in a first way when the print-head moves to the first end; and servicing the print-head in a second way different from the first way, when the print-head moves to the second end.

12. The servicing method according to claim 11, wherein the step of servicing at the first end is cleaning the print-head.

13. The servicing method according to claim 11, wherein the step of servicing at the second end is covering the print-head.

14. The servicing method according to claim 11, the method further comprising one step of moving the print head to the first end before the step of servicing at the first end.

15. The servicing method according to claim 11, the method further comprising one step of moving the print-head to the second end before the step of servicing at the second end.

16. The servicing method according to claim 11, the method further comprising one step of printing by moving the print-head backward and forward along the guiding device.

17. The servicing method according to claim 16, wherein the step of servicing at the first end is performed both before and after the step of printing.

18. An ink-jet printing apparatus, comprising:

a print-head moving forwards and backwards in a printing direction;

a first servicing device of a first kind for servicing the print-head when the print-head moves forwards; and a second servicing device of a second kind different from the first kind, being spaced from the first servicing device, for servicing the print-head when the print-head moves backwards.

19. The ink-jet printing apparatus according to claim 18, wherein the first servicing device is a cleaning device for cleaning the print-head.

20. The ink-jet printing apparatus according to claim 18, wherein the second servicing device is a covering device for covering the print-head.

21. The ink-jet printing apparatus according to claim 18, wherein the printing direction has a first end and a second end opposite to the first end, the first servicing device is disposed adjacent to the first end and the second servicing device is disposed adjacent to the second end.

* * * * *